US009938741B1

(12) United States Patent
Goettl

(10) Patent No.: US 9,938,741 B1
(45) Date of Patent: Apr. 10, 2018

(54) SYSTEM FOR OPERATING ANCILLARY EQUIPMENT WITH MULTI-SPEED POOL PUMPS

(71) Applicant: GSG Holdings, Inc., Chandler, AZ (US)

(72) Inventor: John M. Goettl, Phoenix, AZ (US)

(73) Assignee: GSG Holdings, Inc., Chandler, AZ (US)

( * ) Notice: Subject to any disclaimer, the term of this patent is extended or adjusted under 35 U.S.C. 154(b) by 504 days.

(21) Appl. No.: 14/488,172

(22) Filed: Sep. 16, 2014

Related U.S. Application Data

(60) Provisional application No. 61/878,350, filed on Sep. 16, 2013.

(51) Int. Cl.

| | |
|---|---|
| ***F04D 15/02*** | (2006.01) |
| ***F04B 49/06*** | (2006.01) |
| ***E04H 4/12*** | (2006.01) |
| ***E04H 4/16*** | (2006.01) |
| ***F04D 15/00*** | (2006.01) |

(52) U.S. Cl.
CPC ..... *E04H 4/16* (2013.01); *E04H 4/1245* (2013.01); *E04H 4/1281* (2013.01); *F04B 49/065* (2013.01); *F04D 15/0066* (2013.01); *F04D 15/0254* (2013.01); *F04B 2203/0208* (2013.01)

(58) Field of Classification Search
CPC .. F04D 15/0066; F04D 15/02; F04D 15/0245; F04D 15/0254; F04B 2203/0208; F04B 49/065; F04B 49/10; E04H 4/1209; E04H 4/1245; A61H 2201/0176
See application file for complete search history.

(56) References Cited

U.S. PATENT DOCUMENTS

| | | | | |
|---|---|---|---|---|
| 5,804,080 | A | 9/1998 | Klingenberger | |
| 5,993,669 | A | 11/1999 | Fulmer | |
| 7,854,597 | B2 * | 12/2010 | Stiles, Jr. | F04B 49/20 210/167.1 |
| 8,404,117 | B1 * | 3/2013 | Steinbrueck | C02F 1/008 210/252 |
| 8,820,355 | B2 | 9/2014 | Sutton et al. | |
| 2007/0114162 | A1 | 5/2007 | Stiles et al. | |
| 2008/0073386 | A1 | 3/2008 | Lavorato | |
| 2008/0168599 | A1 | 7/2008 | Caudill et al. | |
| 2012/0073040 | A1 * | 3/2012 | Cohen | E04H 4/1272 4/504 |
| 2012/0234673 | A1 | 9/2012 | Davidson et al. | |

(Continued)

OTHER PUBLICATIONS

Pentair Publication (www.cbpools.net) "The Truth About Two-Speed Pumps".

*Primary Examiner* — Peter J Bertheaud
(74) *Attorney, Agent, or Firm* — Booth Udall Fuller, PLC

(57) ABSTRACT

A system and method of controlling a swimming pool water circulation system. A method may include sensing the electrical current supplied to a variable speed pump to determine when the pump changes speeds and selectively supplying water to one or more ancillary equipment such that the ancillary equipment maintains sufficient water flow to operate. A system may include a multi-speed pump that generates water flow above a first rate, a controller configured to sense a reduction in power drawn by the multi-speed pump below a setpoint, and responsively communicate to the ancillary equipment to suspend operation of the ancillary equipment.

22 Claims, 7 Drawing Sheets

(56) References Cited

U.S. PATENT DOCUMENTS

| | | | | |
|---|---|---|---|---|
| 2013/0129536 | A1* | 5/2013 | Robol | F04B 19/00<br>417/410.1 |
| 2013/0145539 | A1 | 6/2013 | Cooke | |
| 2013/0284649 | A1 | 10/2013 | Tucker | |
| 2014/0034562 | A1 | 2/2014 | Wallace | |

* cited by examiner

SYSTEM FOR OPERATING ANCILLARY EQUIPMENT WITH MULTI-SPEED POOL PUMPS

CROSS REFERENCE TO RELATED APPLICATIONS

This application claims the benefit of U.S. Provisional Patent Application No. 61/878,350, filed Sep. 16, 2013, and incorporates the disclosure of the provisional application by reference thereto.

BACKGROUND ART

Some swimming pool pump systems are designed with a single speed pump, which typically produces a given output at a given pressure. With these systems, ancillary equipment is operated by the filter pump at the given output and pressure. The ancillary equipment may include pool cleaners, chlorinators, and chemical feeders. In order to reduce electrical use requirements of the swimming pool pump system, variable and multi-speed pumps are used as an alternative to single speed pumps. When variable speed pumps are run on slow speed, the pressure/output (measured as GPM) is typically not sufficient to properly operate the attached equipment. Furthermore, the equipment is often damaged due to incorrect operating pressures/outputs. This condition is especially problematic when a variable speed pump is used to replace a single speed pump on existing installations.

Moreover, typical pool pump systems connect electrically operated ancillary equipment in parallel to the pump motor in order to operate the ancillary equipment in unison with the pool pump. Many variable speed motors are internally solid state controlled. The electrical connection to these motors is always "hot" or on, making the former electrical connection unworkable.

SUMMARY

According to an aspect of the disclosure, a swimming pool water circulation system may comprise a multi-speed pump operable to generate a water flow above a first rate, an ancillary equipment operatively connected to the multi-speed pump, a controller in communication with the ancillary equipment, the controller configured to sense a reduction in power drawn by the multi-speed pump, the controller determining, based at least in part on the reduction in power, a second rate of the water flow is below a setpoint corresponding to an operating floor of the ancillary equipment, and the controller communicating to the ancillary equipment to suspend operation.

Particular embodiments may include one or more of the following. The controller may sense the reduction in power by utilizing a sensing coil inductively coupled to a power supply line of the multi-speed pump. The ancillary equipment may suspend operation after receiving the communication to suspend operation. The ancillary equipment may interpret the communication to suspend operation as a warning, and continues to operate. The controller may determine, based at least in part on the reduction in power, a third rate of the water flow is below a second setpoint corresponding to a further operating floor of the ancillary equipment, the third rate of the water flow being lower than both the first and second rates of water flow, the controller communicating a second communication to the ancillary equipment to suspend operation, and the ancillary equipment takes action to suspend operation after receiving the second communication. The ancillary equipment may comprise at least one of a cleaning system, a skimmer, a chlorinator, one or more water features, and ozone generator. The ancillary equipment may be designed to operate effectively above the second rate of water flow. The ancillary equipment may include an automated valve having a valve water flow and being operatively connected to a second ancillary equipment. The automated valve may redirect or stops the valve water flow after receiving the communication to suspend operation, and thereby suspends operation to the second ancillary equipment. The multi-speed pump may comprise a variable speed pump.

According to another aspect of the disclosure, a method of controlling flow to a swimming pool may comprise sensing a reduction of power drawn by a multi-speed pump, determining, based at least in part on the reduction in power, a first rate of a water flow is below a setpoint corresponding to an operating floor of an ancillary equipment operatively connected to the multi-speed pump, and communicating, in response to determining, to the ancillary equipment to suspend operation.

Particular embodiments may include one or more of the following. The sensing of the reduction in power may utilize a sensing coil inductively coupled to a power supply line of the multi-speed pump. The ancillary equipment may suspend operation after receiving the communication to suspend operation. The ancillary equipment may interpret the communication to suspend operation as a warning, and continues to operate. Determining, based at least in part on the reduction in power, a second rate of the water flow is below a second setpoint corresponding to a further operating floor of the ancillary equipment, the second rate of the water flow being lower than the first rate of water flow, communicating a second communication to the ancillary equipment to suspend operation, and suspending operation of the ancillary equipment after receiving the second communication. The ancillary equipment may comprise at least one of a cleaning system, a skimmer, a chlorinator, one or more water features, and ozone generator. The ancillary equipment may be designed to operate effectively above the first rate of water flow. The ancillary equipment may include an automated valve having a valve water flow and being operatively connected to a second ancillary equipment. The automated valve may redirect or stop the valve water flow after receiving the communication to suspend operation, and thereby suspends operation to the second ancillary equipment. The multi-speed pump may include a variable speed pump.

BRIEF DESCRIPTION OF THE DRAWINGS

Illustrative and exemplary embodiments of this disclosure are shown in the drawings in which.

Elements and facts in the figures are illustrated for simplicity and have not necessarily been rendered according to any particular sequence or embodiment.

DETAILED DESCRIPTION

This disclosure, its aspects and implementations, are not limited to the specific components or assembly procedures disclosed herein, as virtually any components consistent with the intended operation of a method and/or system implementation for valve assembly may be utilized. Many additional components and assembly procedures known in the art consistent with the intended pool pump systems and/or assembly procedures for a pool pump system will become apparent for use with implementations of pool pump systems from this disclosure. Accordingly, for example, although particular pool pump systems disclosed, such pool pump systems and implementing components may comprise any shape, size, style, type, model, version, measurement, concentration, material, quantity, and/or the like as is known in the art for such pool pump systems and implementing components, consistent with the intended operation of a pool pump system.

As used herein, the term "multi-speed pump" refers to a pump capable of operating at two or more speeds in addition to off. Examples of multi-speed pumps include two-speed pumps, three-speed pumps, four-speed pumps, five-speed pumps, and so forth. A multi-speed pump may also be a variable speed pump, which can operate at potentially thousands (or more) different speeds (e.g., any speed selectable between 500 and 4000 revolutions per minute ("rpm")). In practice, two-speed, four-speed, and variable speed pumps are among the more common multi-speed pumps purchased for swimming pool, spa, and other aquatic applications. As used herein, the term "pump" refers to a pump comprising a pump mechanism, a motor powering the pump mechanism, and control logic to operate the motor and pump mechanism.

Figure 1:
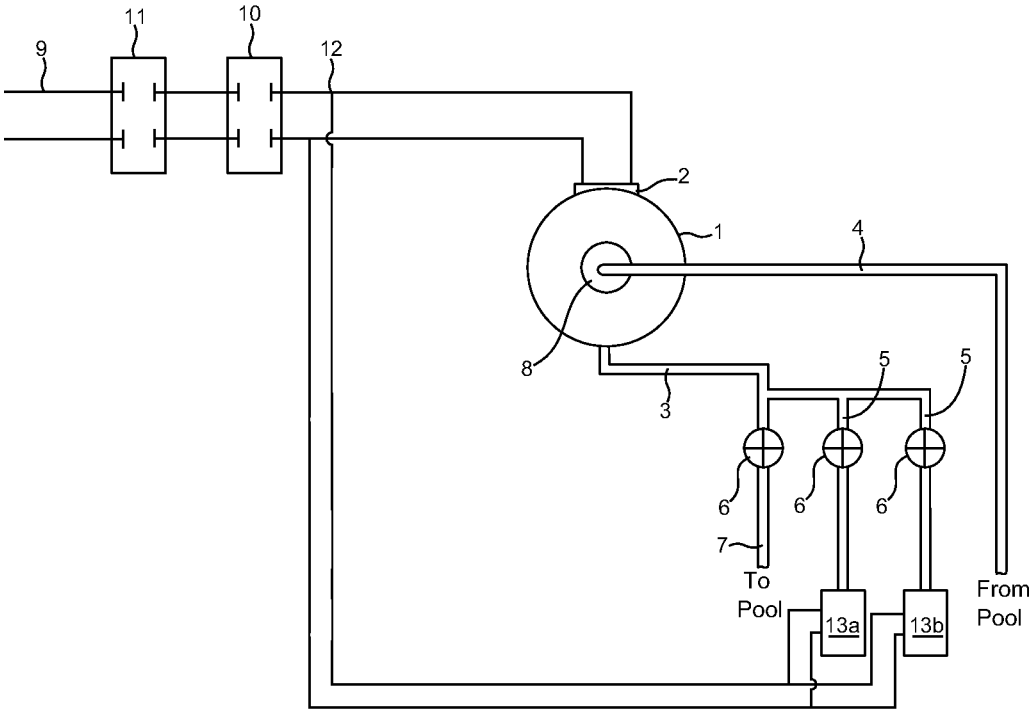
FIG. 1 (PRIOR ART)
FIG. 1 is a schematic of a single-speed pool pump system known in the prior art.

FIG. 1 represents an exemplary schematic of a typical swimming pool pumping system ordinary in the prior art. In FIG. 1, the pump 1 is a single speed pump (such as a 3000 or 3450 rpm motor) that includes an electrical connection 2. Hydraulic connections in the system of FIG. 1 include pressure line 3 and suction line 4. Pressure line 3 is typically connected to one or more conduits to deliver pressurized water to the pool (not shown in FIG. 1). One of these conduits is designated as a return line 7. Other lines 5 from the pressure line 3 are used to provide ancillary function(s) of pressurized output such as cleaning systems, chlorinators, ozone generators, and the like. It is common to include control valves 6 to regulate the pressurized water as desired. The output to pressure line 3 is a function of the pump being on or off and the setting of the associated valve(s) 6. This is a previously known installation using a single speed pump.

As further shown in FIG. 1, suction line 4 conveys water from the pool to the suction port 8 of pump 1. Ancillary equipment 13 is typically any device that requires an electrical input in unison with the pump motor. For example, ancillary equipment 13 may be an ozone generator that is to be operated only when pump 1 is running. There are many types of equipment that can be operated in parallel to pump 1. These are well known and not discussed in detail in this application, although use of these types of equipment is contemplated in implementations that shall be disclosed herein. In FIG. 1, an electrical supply 9, typically 220 VAC, is ordinarily connected to a time clock 10 to switch on or off pump 1 on a predetermined schedule and a manual switch or disconnect 11.

Figure 2:
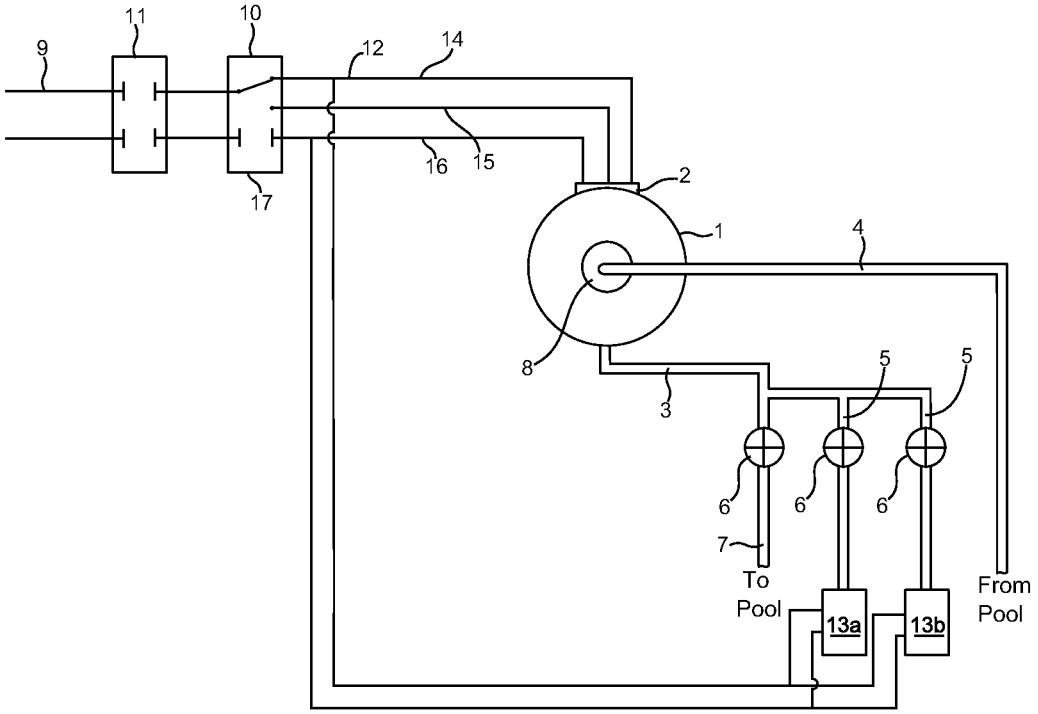
FIG. 2 (PRIOR ART)
FIG. 2 is a schematic of a two-speed pool pump system known in the prior art.

FIG. 2 illustrates an exemplary schematic of a two-speed pool pump system known in the prior art. Common speeds for the two-speed pump include 3000 rpm and 1200 rpm. The two-speed pump typically includes a common lead 16, a low lead 15, and a high lead 14 that comprise an electrical connection 2. The hydraulic connections in the schematic shown in FIG. 2 include a pressure line 3 and a suction line 4. Pressure line 3 is typically connected to one or more conduits 5 to deliver pressurized water to the pool (not shown in FIG. 2). One of the conduits 5 is designated as a return line 7. Other pressure lines 5 may be used to provide ancillary functions of pressurized output 3 to other ancillary equipment, such as, by example and not by limitation, a pool cleaning system, chlorinator, ozone generator, ultraviolet (UV) sanitizer, solar heating system, water feature, fountain, gas heater, heat pump, or any other ancillary device powered within the pool at least in part by water flow or pressure from one or more pressure lines 5 or in the water flow line with the water flow of the one or more pressure lines. It is common to provide control valves in order to regulate the pressurized waters as desired. It can be seen in FIG. 2 that the output to pressure line 3 is a direct function of the pump being on or off, as well as speed selection switch 17 and the setting of the associated valve(s) 6.

It is well known in the prior art that the pressure output 3 and suction 4 are greatly reduced when the pump is operated on low speed compared to high speed. This is particularly problematic with ancillary equipment that requires a minimum and/or maximum flow, pressure, vacuum to operate properly, or with ancillary equipment 13 that should energize in parallel to the pump motor 1. As shown in FIG. 2, ancillary equipment 13 is electrically connected at connection 12 to the high-speed leg via high lead 14. Alternatively, connection 12 might be made to the low-speed leg via low lead 15 rather than the high-speed leg. In pool pump systems configured similar to FIG. 2, the electrical supply to the ancillary equipment 13 cannot be accomplished for both high- and low-speed without complicated and costly circuitry.

Figure 3:
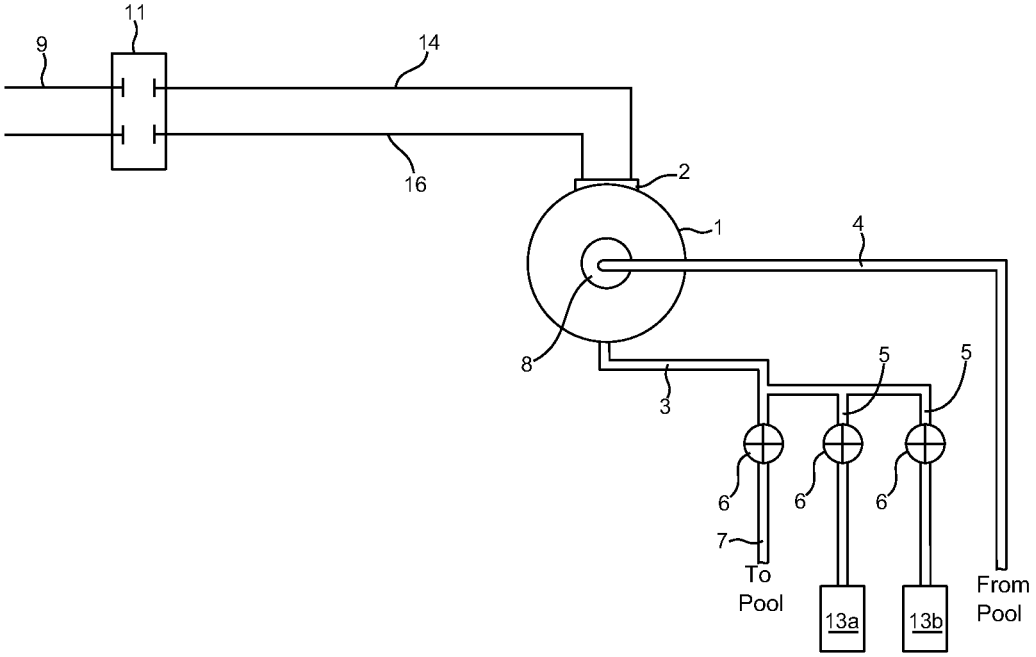
FIG. 3 (PRIOR ART)
FIG. 3 is a schematic of a variable speed pool pump system known in the prior art.

FIG. 3 illustrates an exemplary schematic of a typical variable speed pumping system known in the prior art. In FIG. 3, pump 1 is a variable speed pump, with speeds ranging from 0 rpm to approximately 3500 rpm. Variable speed pump 1 also includes a power source ac line 9, a conventional disconnect switch 11, and a power supply line **14*a* connecting to variable speed pump 1 at electrical connection 2. The hydraulic connections in the schematic shown in FIG. 3 include a pressure line 3 and a suction line 4. Pressure line 3 is typically connected to one or more conduits 5 to deliver pressurized water to the pool (not shown in FIG. 3). One of the conduits 5 is designated as a return line 7. Other pressure lines 5 may be used to provide ancillary functions of pressurized output 3, such as cleaning systems, chlorinators, etc. It is common to provide control valves 6 in order to regulate the pressurized waters as desired. It can be seen in FIG. 3 that the output to pressure line 3 is a direct function of the pump being on or off, and speed of variable speed pump 1 and setting of the associated valve(s) 6**.

It is well known that the pressure output 3 and suction 4 are greatly reduced when the pump is operated at lower speeds compared to higher speeds. This is particularly problematic with ancillary hydraulic equipment that requires a minimum and/or maximum flow, pressure, or vacuum to operate properly. Pool pump systems similar to this illustrated in FIG. 3 provide no mechanism of controlling ancillary outputs 6*a* in response to change in the speed of pump 1. Furthermore, there is no mechanism to control ancillary electrical equipment 13 in response to operation of pump 1. Time clocks sequenced with the times set in pump 1 or other complicated relay systems may be added to the system, but these are complicated and costly, and the clocks often do not remain synchronized with each other. A problem associated with such a configuration is that the electrical supply to ancillary equipment 13 is difficult to accomplish for variable speed pumps without complicated and costly circuitry.

In FIG. 3, suction line 4 conveys water from the pool to the suction port 8 of pump 1. Ancillary equipment 13 may be any device that requires an electrical input in unison with the pump motor 1. For example ancillary equipment 13 may be an ozone generator that is to be operated only when pump 1 is running at a higher speed. Many types of ancillary equipment may be operated in parallel to pump 1.

Figure 4:
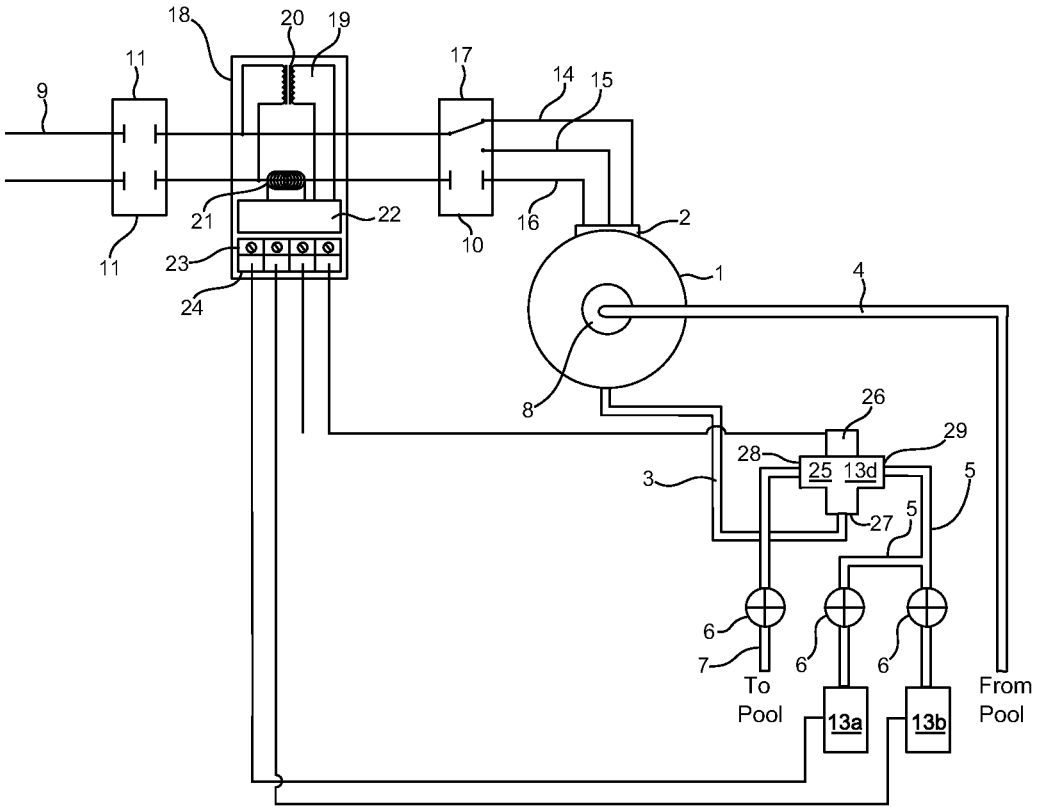
FIG. 4 is a schematic of a two-speed pool pump system with a controller.

In particular implementations disclosed herein, a solution for the electrical connection to various multi-speed pumps is contemplated (e.g., two-speed, four-speed, or variable speed pumps). FIG. 4 illustrates an exemplary schematic of a two-speed pumping system with controller 19 included. In a particular implementation, pump 1 is a two-speed pump, with approximate rpms of 3000 and 1200. In other implementations, two-speed pump 1 may comprise any rpms known in the art. The particular rpms is not critical to the disclosure, only that there are two different rpm settings. Particular speeds are pump specific and different pumps and speeds are used by different systems depending upon the needs of the particular system, the manufacturer of the pump, and the selection of the particular installer of the system. Other multi-speed pumps may include settings for 1200 rpm, 1800 rpm, 2800 rpm and 3800 rpm, or any other particular speeds associated with a particular pump. Pump 1 of FIG. 4 further comprises a common lead 16, a low lead 15, and a high lead 14 comprising an electrical connection 2.

In the implementation illustrated in FIG. 4, the hydraulic connections comprise a pressure line 3 and a suction line 4. In other implementations, the hydraulic connections may comprise any suitable hydraulic connections known in the art. According to one aspect, pressure line 3 is connected to inlet 27 with a three-way valve 25 (such as but not limited to a three-way valve manufactured by Jandy®). Valve 25 is operated by operator 26. Return line 7 is, in an implementation, connected to outlet 28 of valve 25 to conduct water to the pool (not shown in FIG. 4). Pressure line 5 may be coupled to outlet 29 of valve 25, and divided to one or more conduits to deliver pressurized flow to hydraulic ancillary lines in response to valve 25. Pressure line 5 may further be utilized to provide ancillary functions of pressurized output 3 identified as ancillary equipment 13, such as, by example and not by limitation, cleaning systems, chlorinators, ozone generators, skimmers, ultraviolet (UV) sanitizers, solar heating systems, water features, fountains, gas heaters, heat pumps, or any other swimming pool ancillary devices known in the art that are powered at least in part by water flow or pressure from one or more pressure lines. The output of pump 1 that is not directed to ancillary line 5 by valve 25 is returned to the pool through line 7. In some implementations, the system further comprises control valves 6 to regulate the pressurized water as desired. As shown in FIG. 4, the output to pressure line 3 is a function of pump 1 being on or off, the speed selection switch 17, and the setting of the associated valve(s) 6.

As previously referenced, output 3 and suction 4 are typically reduced when the pump is operated on low-speed compared to high-speed. This is problematic with ancillary equipment that requires a minimum and/or maximum flow, pressure, or vacuum to operate properly. Ancillary equipment 13 should be energized parallel to the pump motor 1 only when pump 1 is operating at a suitable rpm. That is, ancillary equipment 13 is designed to operate efficiently above certain flow rates of water, and some ancillary equipment 13 may be damaged if the flow rate of water through it is too low. The implementation illustrated in FIG. 4 provides a unitized control that senses the power or current (amperage) draw of pump 1 and provides one or more electrical outputs to control both ancillary equipment 13 and electrical hydraulic valve(s) 25. Control may be according to preset limits, or setpoint, depending on the requirement of the ancillary equipment 13. Upon sensing a reduction in power or current drawn by pump 1 indicating a reduction in the rate of water flowing from pump 1 being below a setpoint, controller 19 instructs ancillary equipment 13 to suspend operation. Ancillary equipment 13 may then suspend operation or await further instruction from controller 19 before taking action. For example, ancillary equipment 13 may have a warning setpoint and a minimum flow setpoint, and only suspend operation after the rate of water flow drops below the lower minimum flow setpoint. Since current draw of pump 1 is typically the control point, manual switching off of the pump 1 or change in output 3 due to a rpm change are detected. Controller 19 is described in greater detail in FIG. 6.

In a particular example, an in-floor pool cleaning system may be operating in association with a multi-speed pool pump. In this particular example, an installer determines that the particular in-floor pool cleaning system needs 30 gallons/minute (gpm) of flow for proper operation and, by measuring the power input to the multi-speed pool pump, such as through a current-sensing clip, determines that this flow rate corresponds to 2 Amps of current for the particular system associated with the pump and pool. On a controller 19, the installer sets the minimum flow at 30 gpm or 2 Amps, depending upon the settings indicated on the controller 19, couples a current sensor of the controller 19, for example a current-sensing clip clamped around the input, to the input of the multi-speed pool pump, and couples a signal output of the controller 19 to the input to the controller of the in-floor pool cleaning system. In other examples, any other ancillary equipment type or types may be used and one or multiple ancillary equipment types may be used with the same system. An installer would need to set the minimum flow settings for each device either as separate controllers, or as a more complex multi-controller. In some examples, the current sensor may only need to comprise an on-off sensor if the ancillary equipment only needs a minimum amount of water flowing that only requires that the multi-speed pool pump is on.

In FIG. 4, suction line 4 conveys water from the pool to the suction port 8 of pump 1. Ancillary equipment 13 may be any device(s) that require an electrical input in unison with the pump motor 1. By way of example and not limitation, ancillary equipment 13 may, in a particular implementation, comprise an ozone generator that is to be operated only when pump 1 is running. Other types of equipment known in the art may be operated in parallel to pump 1. The use of these other types of equipment is contemplated for use in different implementations disclosed herein.

Figure 5:
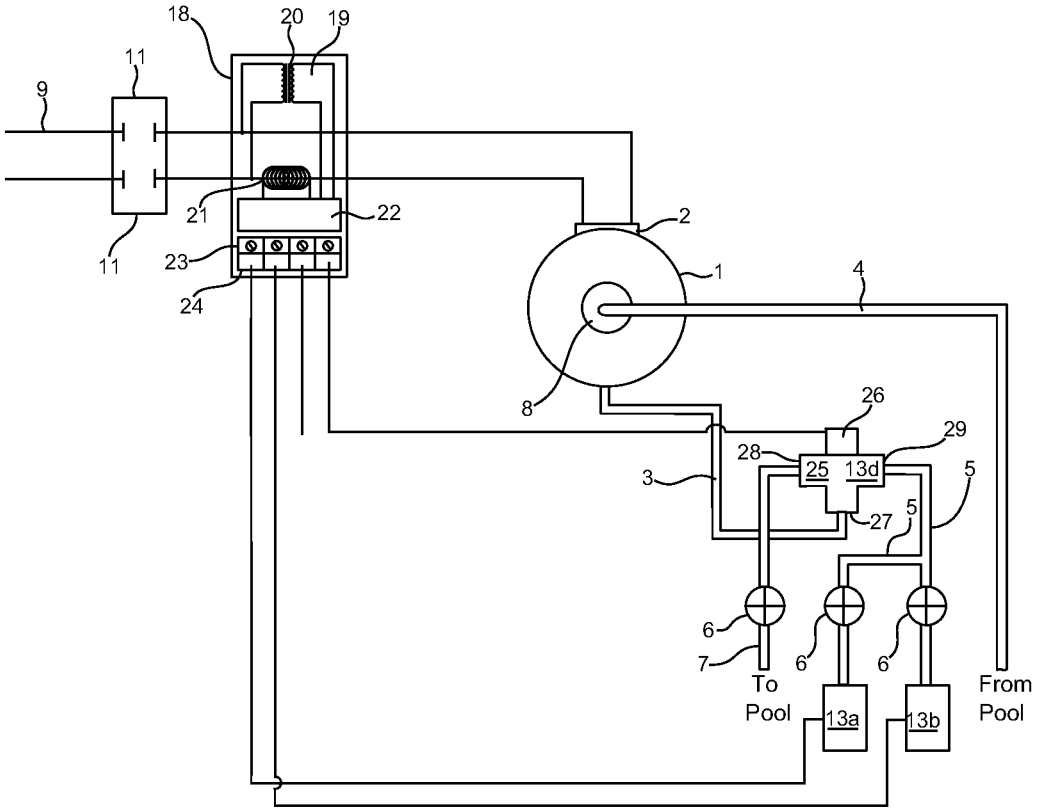
FIG. 5 is a schematic of a variable speed pool pump system with a controller.

FIG. 5 illustrates an exemplary schematic of a variable speed pumping system that includes controller 19. Pump 1 of FIG. 5 comprises a variable speed pump that comprises a power source ac line 9, a conventional disconnect switch 11, and a power supply line 14*a* coupling to variable speed pump 1 at electrical connection 2. In a particular implementation, the speed of the variable speed pump is from 0 rpm to approximately 4000 rpm.

In the implementation illustrated in FIG. 5, the hydraulic connections comprise a pressure line 3 and a suction line 4. In other implementations, the hydraulic connections may comprise any suitable hydraulic connections known in the art. According to one aspect, pressure line 3 is connected to inlet 27 with a three-way valve 25 (such as but not limited to a three-way valve manufactured by Jandy®). Valve 25 is operated by operator 26. Return line 7 is, in an implementation, connected to outlet 28 of valve 25 to conduct water to the pool (not shown in FIG. 4). The output of pump 1 not directed to ancillary line 5 by valve 25 is returned to the pool through line 7. Pressure line 5 may be coupled to outlet 29 of valve 25, and divided to one or more conduits to deliver pressurized flow to hydraulic ancillary lines in response to valve 25. Pressure lines 5 may further be utilized to provide ancillary functions of pressurized output 3, such as but not limited to cleaning systems, chlorinators, or any other ancillary equipment known in the art. In some implementations, the system further comprises control valves 6 to regulate the pressurized water as desired. As shown in FIG. 5, the output to pressure lines 3 is a function of pump 1 being on or off, the speed setting of pump 1 and the setting of the associated valve(s) 6. In some embodiments, valve 25 is considered an ancillary equipment 13.

As previously referenced, output 3 and suction 4 are typically reduced when the pump is operated on low-speed compared to high-speed. This is problematic with ancillary equipment 13 that requires a minimum and/or maximum flow, pressure, or vacuum to operate properly. Ancillary equipment 13 should be energized parallel to the pump motor 1 only when pump 1 is operating at a suitable rpm. The implementation illustrated in FIG. 4 provides a unitized control that senses the current (amperage) draw of pump 1 and provides one or more electrical outputs to control both ancillary equipment 13 and electrical hydraulic valve(s) 25. Control may be according to preset limits, depending on the requirement of the ancillary equipment 13. Since current draw of pump 1 is typically the control point, manual switching off of pump 1 or change in output 3 due to a rpm change are detected. A reduction in the power or current drawn by pump 1 is indicative of a reduction in speed that can be calculated. From this, it can be determined that the rate of water flowing from pump 1 is reduced to a lower rate as the speed drops and less power and current are drawn by the pump 1. Conversely, increases in power and current consumption indicate increases in pump 1 speed and the rate of water flow from pump 1. Controller 19 is described in greater detail in FIG. 6.

In FIG. 5, suction line 4 conveys water from the pool to the suction port 8 of pump 1. Ancillary equipment 13 may be any device(s) that require an electrical input in unison with the pump motor 1. By way example and not limitation, ancillary equipment 13 may, in a particular implementation, comprise an ozone generator that is to be operated only when pump 1 is running. Other types of equipment known in the art may be operated in parallel to pump 13. The use of these other types of equipment is contemplated for use in different implementations disclosed herein.

In a two-speed motor, the speed setting of the motor is determined by connecting the common connection and the high speed connection together for high speed; connecting the common connection and the low speed connection together for low speed. There are separate windings in a two-speed motor that work to run the motor as a 2 pole for high speed and a 4 pole motor for low speed. The speed selector switch is external of the motor and is controlled external of the motor. It provides for selection of the different internal motor windings. Usually there are two settings in two speed pool pumps—3000 and 1200 rpms, although other speeds are possible (e.g., 3450 and 1200 rpms).

Variable speed motors are usually solid state controlled internally within the motor itself. The time clock and speed controller are all built into the motor. The only electrical connection is the line in and this line is generally on to provide power to the internal control circuits with in the pump. The pump motor may be off while the power line in is on. There is no way to easily sense the status of these pumps in order to control the ancillary equipment.

Since the amperage draw of a pump varies by the load on the motor it can be used to detect if a motor is on or off and the comparative load on the motor. When pump is on high or higher speed, the amperage draw will be more than when the same pump is on low or lower speed. The amperage is typically read and compared to setpoints for each of one or more output to control ancillary equipment 13. The devices disclosed in this disclosure are nearly identical for control of two-speed and variable speed pumps/motors since it senses only current flow to the pump. It does not matter what type motor is implemented.

Figure 6:
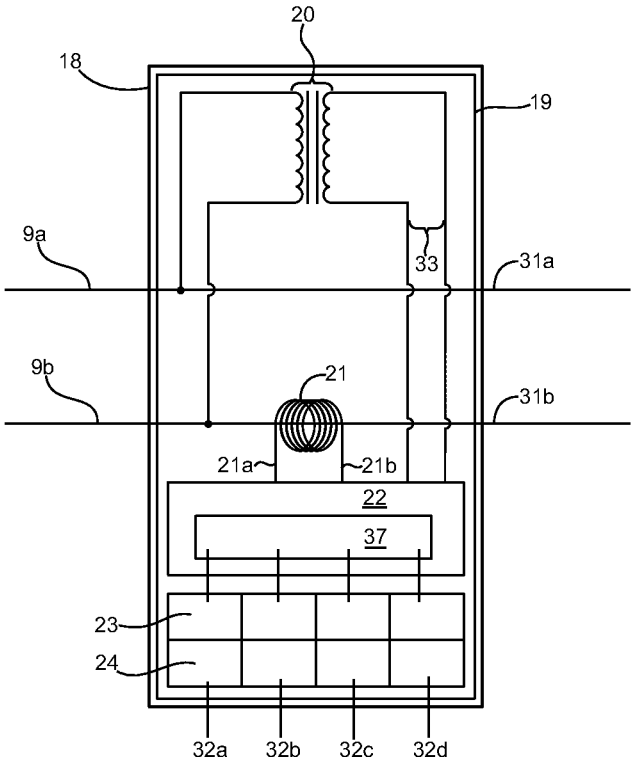
FIG. 6 is a schematic of an exemplary pool pump system controller.

FIG. 6 illustrates an exemplary schematic of controller 19, implementations of which are utilized in the exemplary schematics illustrated in FIGS. 4 and 5. In some implementations, a weather tight enclosure 18 is utilized with controller 19 to house components and provide for ease of installation with a cover, inlet/outlet fittings in the ordinary manner.

Controller 19 further comprises a power source, such as ac line 9 comprising lines 9*a* and 9*b*, which carry the same amount of alternating current except line 9*a* is 180° out of phase with line 9*b*. The voltage between line 9*a* and line 9*b* is referred to as "line voltage 9." Line voltage 9 may be, for example, 220 VAC or 120 VAC. This provides a convenient coupling to input ac power. In some implementations, all further connections and components are unitized as a complete system, with the exception of output connections at 32*a-d* and 31*a-b*. Controller 19 may further comprise or otherwise be in electrical communication with step down transformer 20, which converts line voltage 9 to suitable control voltage 33 for operation of components (e.g., circuit controller 22) and attached ancillary equipment 13 (as shown in FIGS. 5-6). Transformer 20 may also be described as a power supply for various internal electronic components, such as setpoint controls 23 and control logic 37 in some implementations.

According to one aspect, controller 19 comprises a current sensing coil 21 that surrounds, and is inductively coupled to, line 9*b* in order to sense current flow to the pool pump 1 (as shown in FIGS. 5-6). As pump speed increases, the amp draw of pump 1 is also increased, thereby creating a higher voltage across coil outputs 21*a* and 21*b* (collectively referred to as "coil output voltage 21"). As shown in FIG. 6, the coil output voltage 21 can vary from 0 when the pump is in an off position to a maximum that is dependent upon pump 1 size and coil 21 design. Amperage draw of pump 1 is derived by factoring coil output voltage 21 multiplied by the line voltage 9. It is not, however, always necessary to calculate amperage. Units of coil output voltage 21 could be used to sense pump current draw and factored in control logic 37 of circuit controller 22. As an alternative, coil 21 can surround line 9*a* and measure the current on line 9*a* similar to the explanation above for line 9*b*.

When coil output voltage 21 reaches a user setpoint, switches 24 are opened or closed according to logic supplied by each corresponding setpoint control 23. Each setpoint control 23 corresponds to rate of water flow required to operate an ancillary equipment 13. A setpoint control 23 can be set to correspond to an absolute operational floor (i.e., absolute minimum rate of water flow) for the ancillary equipment 13 to function. Alternatively, a setpoint control 23 may correspond to some rate of flow above the minimum rate of water flow required by the ancillary equipment 13. The switches 24 are control switches set by control logic 37 and setpoint controls 23 to control output to the ancillary equipment 13 shown in FIGS. 4-5. These are likely to be implemented as solid state or small mechanical relays, though other relays are contemplated. In FIG. 6, four exemplary setpoint controls 23 and switches 24 are shown, which correspond to control outputs 32*a* through 32*d*. That is, this example illustrates four sets of setpoint contols 23, switches 24, and control outputs 32, namely: 23*a*, 24*a*, 32*a*; 23*b*, 24*b*, 32*b*; 23*c*, 24*c*, 32*c*; and 23*d*, 24*d*, 32*d*. In other implementations, any number of switches appropriate for the particular controller 19 may be utilized and are contemplated in this disclosure. A particular application of the controller 19 may comprise only one or many of these setpoints control 23 and switch 24 sets. FIG. 6 illustrates one example where the set of setpoint control 23*d*, switch 24*d*, and control output 32*d* provide hydraulic valve control to open, shut, or redirect pressure flow 3 in FIG. 5 at valve 25 in FIG. 5. Each control output 32*a-d* may comprise two or more wires (e.g., a combination of power, neutral, and/or ground wires) to provide power to ancillary equipment 13 in addition to switching control. A remote switch (not shown) may be normal open or normal closed, and operated in the same manner as described for switches 24.

Figure 7:
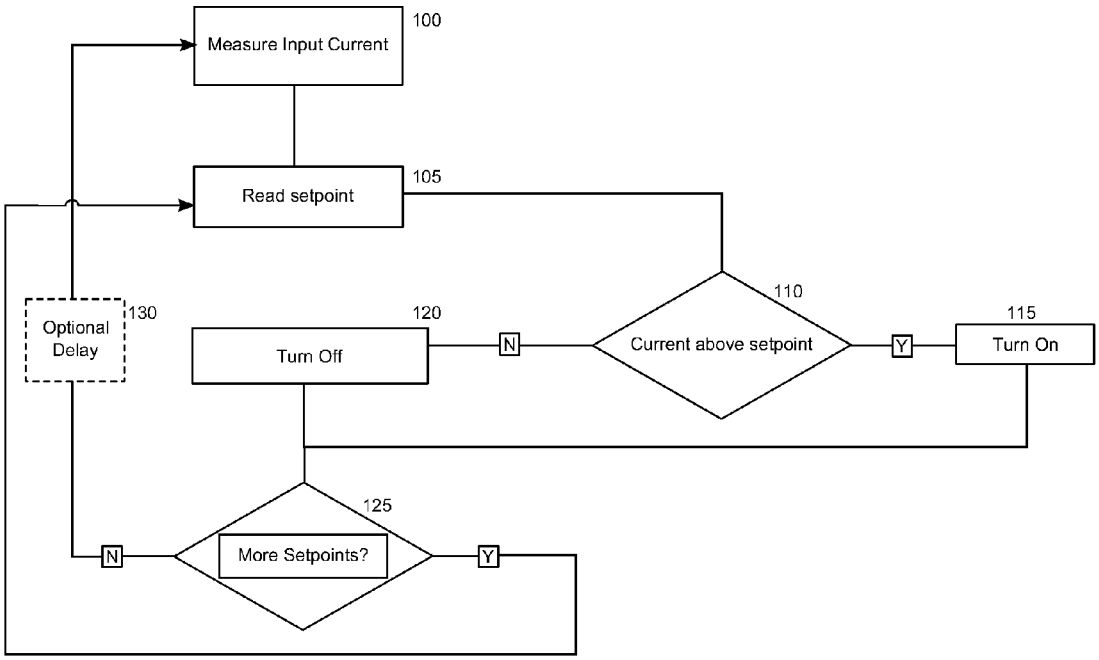
FIG. 7 is a flowchart depicting methods of controlling a pool pump system.

FIG. 7 illustrates a flowchart describing an embodiment of managing a swimming pool pump system with a variable speed pump 1 and one or more ancillary equipment 13. The electrical current drawn, or amp draw, by pump 1 is measured 100. The setpoint for a particular ancillary equipment 13 is read 105. The system then determines 110 if the read setpoint 105 is above the measured input current 100 and, if yes, switch 24 is set to "on" 115, or, if no, switch 24 is set to "off" 120. The system may have additional setpoints stored for additional ancillary equipment 13 or have one piece of ancillary equipment 13 having multiple setpoints. The system determines if more setpoints need to be compared 125. If so, the process loops back to 105 to read the next setpoint. If no (i.e., all setpoints have been read and compared), the process loops back to 100 to begin anew by measuring the input current. Optional delay 130 may be inserted before the system starts a new measuring and comparing cycle.

Various embodiments exist as illustrated in FIG. 7 or described in disclosed embodiments. Measuring the input current 100 for pump 1 may be derived by methods including comparing the measured coil output voltage 21 and the line voltage 9. The input current can be measured 100 by comparing voltages and not calculating amperage. In a case with two or more pieces of ancillary equipment 13, the setpoints may be different and the system may determine 110 that, for example, one ancillary equipment 13 remains on 115 while one or more additional ancillary equipment 13 are turned off 120. Determining whether the current is above a setpoint 110 can easily be modified to determine whether the current is below a setpoint and still turn ancillary equipment 13 on and off according to the disclosed embodiments. Turning ancillary equipment 13 off may comprise closing a valve (e.g., valves 6 or valve 25) to prevent water flow to ancillary equipment 13 or electrically powering off or instructing ancillary equipment 13 not to operate. The logical converse applies to turning ancillary equipment 13 on. The system may also be installed without automated valves and be limited to providing warning lights, sounds or messages advising that ancillary equipment 13 should be manually turned on or off. Setpoints can also be defined to reduce or increase supply water flow to ancillary equipment 13 instead of completely shutting or opening the supply water flow. In addition, the length of optional delay 130 may vary depending on system design. For example, optional delay 130 may be on the order of seconds (e.g., 1-60 sec.), minutes (e.g., 1-60 min.), or hours (e.g., 1-24 sec.). One embodiment utilizes an optional delay 130 with a delay between 1 and 20 minutes.

In places where the description above refers to particular implementations of a pool pump assembly, it should be readily apparent that a number of modifications may be made without departing from the spirit thereof and that these implementations may be applied to other valve assemblies and pool pump systems.

I claim:

1. A swimming pool water circulation system, comprising:

a multi-speed pump operable to generate a water flow above a first rate;

an ancillary equipment operatively connected to the multi-speed pump, the ancillary equipment comprising an automated valve having a valve water flow and being operatively connected to a second ancillary equipment;

a controller in communication with the ancillary equipment, the controller configured to sense a reduction in power drawn by the multi-speed pump, the controller determining, based at least in part on the reduction in power, if a second rate of the water flow is below a setpoint corresponding to an operating floor of the ancillary equipment, and the controller communicating to the ancillary equipment to suspend operation in response to the controller's determination that the second rate of the water flow is below the setpoint;

wherein the automated valve redirects or stops the valve water flow after receiving the communication to suspend operation, and thereby suspends operation to the second ancillary equipment.

2. The system of claim 1, wherein the controller senses the reduction in power by utilizing a sensing coil inductively coupled to a power supply line of the multi-speed pump.

3. The system of claim 1, wherein the ancillary equipment suspends operation after receiving the communication to suspend operation.

4. The system of claim 1, wherein the ancillary equipment interprets the communication to suspend operation as a warning, and continues to operate.

5. The system of claim 1, further comprising:

the controller determining, based at least in part on the reduction in power, if a third rate of the water flow is below a second setpoint corresponding to a further operating floor of the ancillary equipment, the third rate of the water flow being lower than both the first and second rates of water flow;

the controller communicating a second communication to the ancillary equipment to suspend operation in response to the controller determining that the third rate of water flow is below the second setpoint; and wherein the ancillary equipment takes action to suspend operation after receiving the second communication.

6. The system of claim 1, wherein the ancillary equipment comprises at least one of a cleaning system, a skimmer, a chlorinator, one or more water features, and an ozone generator.

7. The system of claim 1, wherein the ancillary equipment is designed to operate effectively above the second rate of water flow.

8. The system of claim 1, wherein the multi-speed pump is a variable speed pump.

9. The system of claim 1, wherein the second ancillary equipment comprises at least one of a cleaning system, a skimmer, a chlorinator, one or more water features, and ozone generator operably coupled to the automated valve.

10. A method of controlling flow to a swimming pool, comprising:

sensing a reduction of power drawn by a multi-speed pump;

determining, based at least in part on the reduction in power, if a first rate of a water flow is below a setpoint corresponding to an operating floor of an ancillary equipment operatively connected to the multi-speed pump, the ancillary equipment comprising an automated valve having a valve water flow and being operatively connected to a second ancillary equipment;

communicating to the ancillary equipment to suspend operation in response to determining that the first rate of water flow is below the setpoint;

wherein the automated valve redirects or stops the valve water flow after receiving the communication to suspend operation, and thereby suspends operation to the second ancillary equipment.

11. The method of claim 10, wherein the sensing the reduction in power utilizes a sensing coil inductively coupled to a power supply line of the multi-speed pump.

12. The method of claim 10, wherein the ancillary equipment suspends operation after receiving the communication to suspend operation.

13. The method of claim 10, wherein the ancillary equipment interprets the communication to suspend operation as a warning, and continues to operate.

14. The method of claim 10, further comprising:

determining, based at least in part on the reduction in power, if a second rate of the water flow is below a second setpoint corresponding to a further operating floor of the ancillary equipment, the second rate of the water flow being lower than the first rate of water flow;

communicating a second communication to the ancillary equipment to suspend operation in response to determining that the second rate of the water flow is below the second setpoint; and suspending operation of the ancillary equipment after receiving the second communication.

15. The method of claim 10, wherein the ancillary equipment comprises at least one of a cleaning system, a skimmer, a chlorinator, one or more water features, and an ozone generator.

16. The method of claim 10, wherein the ancillary equipment is designed to operate effectively above the first rate of water flow.

17. The method of claim 10, wherein the multi-speed pump is a variable speed pump.

18. The system of claim 10, wherein the second ancillary equipment comprises at least one of a cleaning system, a skimmer, a chlorinator, one or more water features, and ozone generator operably coupled to the automated valve.

19. A swimming pool water circulation system, comprising:

a multi-speed pump operable to generate a water flow above a first rate;

an ancillary equipment operatively connected to the multi-speed pump;

a controller in communication with the ancillary equipment, the controller configured to sense a reduction in power drawn by the multi-speed pump, the controller determining, based at least in part on the reduction in power, if a second rate of the water flow is below a setpoint corresponding to an operating floor of the ancillary equipment, and the controller communicating to the ancillary equipment to suspend operation in response to the controller's determination that the second rate of the water flow is below the setpoint;

the controller determining, based at least in part on the reduction in power, if a third rate of the water flow is below a second setpoint corresponding to a further operating floor of the ancillary equipment, the third rate of the water flow being lower than both the first and second rates of water flow;

the controller communicating a second communication to the ancillary equipment to suspend operation in response to the controller determining that the third rate of water flow is below the second setpoint; and wherein the ancillary equipment takes action to suspend operation after receiving the second communication.

20. The system of claim 19, wherein the ancillary equipment comprises at least one of a valve, cleaning system, a skimmer, a chlorinator, one or more water features, and an ozone generator.

21. A method of controlling flow to a swimming pool, comprising:

sensing a reduction of power drawn by a multi-speed pump;

determining, based at least in part on the reduction in power, if a first rate of a water flow is below a setpoint corresponding to an operating floor of an ancillary equipment operatively connected to the multi-speed pump;

communicating to the ancillary equipment to suspend operation in response to determining that the first rate of water flow is below the setpoint determining, based at least in part on the reduction in power, if a second rate of the water flow is below a second setpoint corresponding to a further operating floor of the ancillary equipment, the second rate of the water flow being lower than the first rate of water flow;

communicating a second communication to the ancillary equipment to suspend operation in response to determining that the second rate of the water flow is below the second setpoint; and suspending operation of the ancillary equipment after receiving the second communication.

22. The system of claim 21, wherein the ancillary equipment comprises at least one of a valve, cleaning system, a skimmer, a chlorinator, one or more water features, and an ozone generator.

* * * * *